United States Patent [19]

Bowman

[11] 4,214,955

[45] Jul. 29, 1980

[54] ELECTROLYTIC PURIFICATION OF METALS

[75] Inventor: Kenneth A. Bowman, Leechburg, Pa.

[73] Assignee: Aluminum Company of America, Pittsburgh, Pa.

[21] Appl. No.: 522

[22] Filed: Jan. 2, 1979

[51] Int. Cl.[2] ..... C25C 3/00; C25C 3/02; C25C 3/04; C25C 3/06

[52] U.S. Cl. ..... 204/67; 204/64 R; 204/66; 204/69; 204/70

[58] Field of Search ..... 204/67, 70, 64 R, 66, 204/69

[56] References Cited

U.S. PATENT DOCUMENTS

| | | | |
|---|---|---|---|
| 673,364 | 4/1901 | Hoopes | 204/67 |
| 3,798,140 | 3/1974 | Sullivan et al. | 204/67 |
| 4,115,215 | 9/1978 | Das et al. | 204/67 |
| 4,118,292 | 10/1978 | Fray et al. | 204/67 |

*Primary Examiner*—Howard S. Williams
*Attorney, Agent, or Firm*—Andrew Alexander

[57] ABSTRACT

A method of electrolytically separating metal from impurities comprises providing the metal and impurities in a molten state in a container having a porous membrane therein, the membrane having a porosity greater than 48%, being capable of containing the molten metal in the container, and being permeable by a molten electrolyte. The metal is electrolytically transferred through the membrane to a cathode in the presence of the electrolyte for purposes of separating or removing impurities from the metal.

10 Claims, 1 Drawing Figure

ELECTROLYTIC PURIFICATION OF METALS

INTRODUCTION

This invention relates to a method for purifying metal and more particularly to a method for electrolytically separating metal from impurities.

With respect to aluminum, for example, silicon alloys thereof have been conventionally prepared by adding to commercial grade aluminum a desired amount of silicon, normally prepared independently, consequently resulting in a relatively high priced aluminum alloy product. In other processes, the aluminum-silicon alloys are prepared directly from alumina-silica ore. For example, Seth et al in U.S. Pat. No. 3,661,562 disclose that aluminum-silicon alloy can be prepared in a blast furnace wherein coke or other suitable carbonaceous material is fed into one reaction zone and a mixture of coke and alumina-silica ore is fed into a second reaction zone. Hot carbon monoxide gases produced by combustion of the coke are introduced into the second reaction for reducing the alumina-silica ore. However, such or similar methods of producing aluminum-silicon alloys often result in the alloy having very high silicon and iron contents which normally have to be reduced or lowered for the alloy to have commercial utility. One method of keeping the iron content low in such alloys is to use alumina-silica containing ores with low iron content. Another method involves the steps of lowering the iron content by physical beneficiation prior to the reduction process. However, because of the unfavorable economics and extra steps involved, it is preferred to start with an alumina-silica containing ore having a high iron content, which, of course, results in an alloy being high in silicon and iron as noted above and the need for purification thereof.

Purification of aluminum alloys using electrolytic cells is disclosed in the prior art. For example, Hoopes U.S. Pat. No. 673,364 discloses that if impure aluminum, in a melted state, is used as an anode in an electrolytic cell, especially one in which the electrolyte contains fused aluminum fluoride and a fluoride of a metal more electropositive than aluminum, according to the patent, pure aluminum will be deposited at the cathode and fluorine is set free at the anode when current is passed through the cell.

In another method of purifying aluminum-silicon alloys, Sullivan et al in U.S. Pat. No. 3,798,140 disclose electrolytically producing aluminum and silicon from aluminum-silicon alloys using a NaCl, KCl and $AlCl_3$ or $AlF_3$ electrolyte. The aluminum-silicon alloy is provided as an anode in a perforated graphite anode crucible. A perforated graphite screen is provided around a cathode and around an alumina crucible to prevent any fine silicon liberated during the electrolysis from floating into the cathode department. However, production of purified aluminum in this process is limited by its effective current density which is only 150 to 200 amps/$ft^2$ in the chloride-fluoride electrolyte.

The present invention overcomes the problems encountered in the prior art for purifying metals such as aluminum or lead, for example, and provides a method for purifying metals in a highly economical manner.

SUMMARY OF THE INVENTION

An object of the present invention is to purify metals.

Another object of the present invention is to purify metal containing high levels of alloying constituents.

Yet another object of the present invention is to provide an electrolytic method for purifying metal.

Yet another object of the present invention is to provide an electrolytic method of separating metals from impurities using a porous membrane.

In accordance with these objectives, there is provided a method for purifying metal by electrolytically separating or removing impurities therefrom. The method comprises providing contaminated metal in a substantially molten state in a container having a porous membrane therein, the membrane having a porosity greater than 48%, being capable of containing the molten metal in the container and being permeable by a molten electrolyte. The metal is electrolytically transferred through the porous membrane to a cathode in the presence of the electrolyte, thereby substantially purifying the metal by separating it from the impurities.

BRIEF DESCRIPTION OF THE DRAWING

The sole FIGURE shows in cross section a form of apparatus suitable for use in the present invention.

DETAILED DESCRIPTION OF THE PRESENT INVENTION

Figure 1:
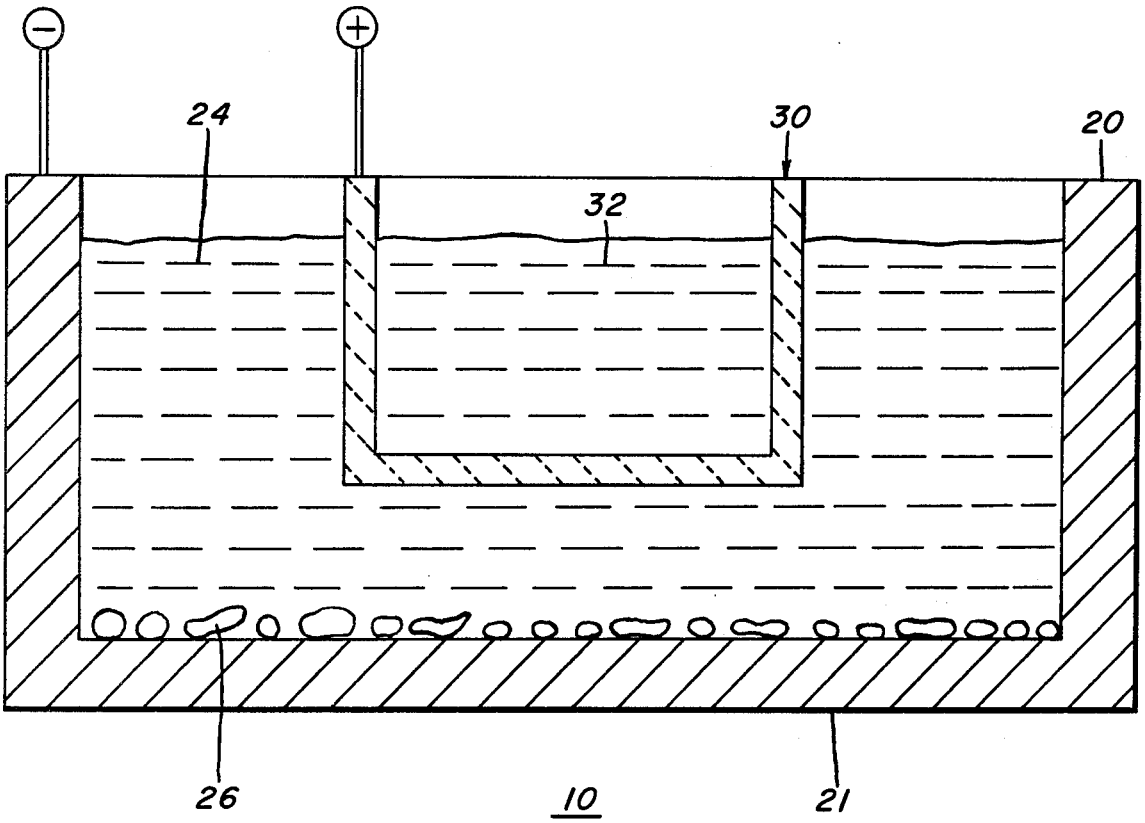

Aluminum alloy as referred to herein is an alloy containing typically not more than 99.9 wt.% aluminum. However, alloys which can be purified in accordance with the present invention can contain large amounts of impurities. For example, the aluminum alloys can contain as much as 50 wt.% Si. Also, the alloys can contain large amounts of Fe, for example, 20 wt.%. In addition, other alloying constituents normally associated with aluminum, e.g. Ti, can usually be removed in accordance with the present invention. Also, the alloying constituents can be reduced to a very low level. That is, the present invention can be useful in providing high purity aluminum, even when the starting material is relatively pure.

By reference to the FIGURE, there is shown an electrolytic cell configuration 10 in which an aluminum alloy can be purified substantially in accordance with the present invention. The cell comprises an outer container 20 which, at least a portion thereof, is constructed of graphite or a like material which can act as a cathode in the cell. For example, the cell may be constructed such that only bottom 21 or a portion thereof may serve as a cathode. Electrolytic cell 10 further comprises a second container 30 in communication with the cathode referred to by means of electrolyte 24. Container 30 serves as a vessel, as shown in the FIGURE, in which aluminum alloy 32 is provided in molten form. Container 30 should be constructed of a material resistant to attack by molten aluminum alloy 32 and electrolyte 24 and must have a wall or a portion of a wall thereof permeable or penetrable by an ion containing one or more aluminum atoms which can be electrolytically transferred or transported through the wall to the cathode.

Container 30 can be constructed from a conductive or non-conductive porous material. If container 30 is constructed from non-conductive porous material or very thin, conductive membrane, an anode should be projected into aluminum alloy 32 in order that the aluminum can be electrolytically transported to the cathode. If container 30 is made from a conductive, porous material, then the container can act as the anode, as shown in the FIGURE.

With respect to the permeable wall, it is preferred that such material be a carbonaceous material when separation of constituents such as silicon, iron and the like from aluminum is desired. However, it is within the purview of the present invention to select other materials permeable by an ion containing one or more aluminum atoms but which restricts the passage of molten aluminum and constituents such as those just mentioned.

With respect to the permeable wall, it has been discovered that for efficient production of purified or refined metal the porosity should be as high as possible. That is, it has been discovered that a permeable membrane having a high degree of porosity greatly increases the amount of metal which can be transferred. While the inventor does not necessarily wish to be bound by any theory of invention, it is believed that the high level of metal transfer results from greater contact between the molten metal and the electrolyte. That is, it is believed that high porosity greatly increases the active area of the molten metal anode. In addition, it is believed that the higher porosity also permits the membrane to contain higher levels of electrolyte. Thus, it is believed that the high level of metal transfer results from greatly reduced resistance produced by the combination of increased area of active metal and increased amounts of electrolyte in the membrane.

The porosity level of the membrane which can be used in accordance with the present invention can be as high as 97%. However, for greater efficiency, the porosity of the membrane should be greater than 48% and preferably range from about 70 to 95%. By porosity as used herein is meant the ratio of the volume of the voids to the geometric volume of the membrane. Typically, the thickness of such membrane is less than ¼ inch and preferably less than ⅛ inch. A material from which the porous membrane may be constructed is carbon. Porous carbon, which has been found to be quite suitable, may be obtained from Chemotronics Internations, Inc., Ann Arbor, Mich., under the name Reticulated Vitreous Carbon. Further, felts such as felts made from carbon or graphite fibers may be used. The carbon felts may be fabricated from fibers held together by a suitable binder. Such materials are available from Fiber Materials Incorporated, Biddeford, Maine, under the designation GH felt. The felts referred to should also have a porosity greater than 50% and preferably in the range of 70 to 97%. In addition, it has been found that woven type membranes can be used with satisfactory results. The woven membranes can use continuous or discontinuous fibers such as carbon or graphite fibers. The woven membranes can utilize various weaves with satisfactory results being obtained with a twill weave. Woven membranes of the type referred to may also be obtained from Fiber Materials Incorporated. For best results, the thickness of the woven membrane should be controlled to less than ⅛ inch and preferably be in the range of 0.01 to 0.1 inch with a highly suitable thickness being in the range of about 0.02 to 0.04 inch. The woven membranes have the advantage of having higher strengths while being relatively thin. Typically the woven membrane should also have a porosity greater than 48% and preferably in the range of about 70 to 97%. Porous membranes such as foamed membranes, e.g. foamed carbon, or porous membranes fabricated from particles, e.g. carbon particles, held together with a suitable binder tend to be lacking in strength at these lower thicknesses and, therefore, can be preferred on a lesser basis.

Porous carbon or other porous membrane used in this application is further characterized by being impenetrable or impermeable to molten aluminum and alloying constituents thereof but permeable by molten salt used as the electrolyte.

With respect to pore size, it should be noted that its size can vary depending on the amount of head, the temperature of the molten aluminum, and the wettability of the porous member. Also, the electrolyte employed as well as the alloying constituents can affect the size of the pore which will be impenetrable or impervious to molten aluminum and alloying constituents thereof.

Electrolyte 24 is an important aspect of the present invention. The electrolyte should comprise an aluminum fluoride or chloride and at least one salt selected from the group consisting of lithium, potassium, sodium, calcium and magnesium halide with a preferred electrolyte comprising aluminum chloride and lithium chloride. The use of lithium chloride permits the use of high current densities without adversely affecting the operation of the cell as by heat generation due to high resistance encountered in the electrolyte.

The electrolyte can comprise, by weight percent, 5 to 99% LiCl and 1 to 25% $AlCl_3$, with the balance being at least one of the group consisting of sodium, potassium, calcium and magnesium chlorides. Preferably, the composition is 85 to 99% LiCl and 1 to 15% $AlCl_3$. $AlF_3$ can be used instead of $AlCl_3$.

The temperature of the electrolyte can affect the overall economics of the process. If the electrolyte temperature is too low, the purified aluminum can be difficult to collect. Also, low temperatures can result in low electrolyte conductivity and consequently low cell productivity. Too high operating temperatures can diminish the useful life of the anode and cathode as well as cause vaporization of the salt. Thus, while the temperature can range from 675° to 925° C., a preferred temperature is in the range of 700° to 850° C.

In the process of the present invention, the cell can be operated at high current densities resulting in high yields of purified aluminum. Also, the cell can be operated at high current densities without encountering high resistances in the electrolyte and the resulting generation of undesirable heat and its attendant problems. The cell can be operated at a voltage of 1 to 5 volts and a current density in the range of 200 to 4500 amps/$ft^2$, or in certain cases higher, with a preferred voltage being less than 2.0 volts and a minimum current density which should not be less than 200 amps/$ft^2$ and preferably at least 300 amps/$ft^2$.

In operation of the electrolytic cell, molten electrolyte 24 is provided in container 20 and preferably kept at a temperature in the range of 700° to 850° C. Aluminum alloy in molten form is placed in container 30. An electrical current is passed from the anode to the cathode and aluminum is transported by virtue of the electrolyte through the porous membrane to the cathode where it is deposited and collected. The porous wall restricts the passage of alloying constituents such as silicon and iron and other residues and hence prevents the contamination of the purified aluminum under these operating conditions. If container 30 is constructed from a conductive, porous material, purified aluminum 26 should not be permitted to accumulate in container 20 until it touches container 30 since this would short-circuit the cell.

It will be appreciated by those skilled in the art that a number of anode containers, such as shown in the FIGURE, may be positioned within the cathode or outer container 20 to increase the production of the cell. Also, it will be appreciated that other configurations employing the permeable membrane may be used. For example, container 20 may be constructed from a non-conductive material and the porous membrane may be used to divide the container, providing an area to contain the impure molten aluminum 32 and another area or space in which to provide the electrolyte. The aluminum may be purified by providing an anode in the impure aluminum and a cathode in the electrolyte and passing electric current therebetween.

In the cell of the present invention, the distance between the anode and cathode should be closely controlled in order to aid in minimizing the voltage drop across the cell. Thus, such distance should not be more than 1.0 inch and preferably not more than 0.5 inch.

The present invention, as well as providing purified aluminum, is advantageous in that it can provide high purity silicon. In addition, ferro-silicon compounds can be recovered since these materials do not pass through the porous membrane. Furthermore, while it has been noted hereinabove that the invention was particularly useful with respect to purifying aluminum alloys obtained from the high silicon ores, it is also useful in purifying aluminum scrap containing iron and silicon materials. Also, the invention can be used to purify aluminum used in clad products, e.g. brazing alloy.

While the invention has been described with respect to aluminum, it should be noted that is has application to refining or purifying other metals such as magnesium, zinc, tin, lead, bismuth, antimony and cadmium, for example. It will be appreciated that the electrolyte used in each instance must contain ions of the metal to be collected at the cathode. Other considerations in selecting the electrolyte will include stability, density, conductivity and cost, for example.

With respect to purification of lead or lead alloys, an electrolyte should contain lead chloride and at least one of the salts selected from the group consisting of lithium, sodium, potassium, aluminum, magnesium and calcium chloride. A typical electrolyte can comprise about 80 wt.% lead chloride, about 11 wt.% potassium chloride and about 9 wt.% sodium chloride. A suitable temperature at which the cell may be operated is in the range of about 350° to 700° C. for lead purification. Lead alloys referred to are those which would contain antimony, bismuth or tin, for example. Thus, when a lead alloy is purified in accordance with the invention, lead is deposited at the cathode and antimony and bismuth remain in the anode container.

With respect to purification of zinc by removing metals such as iron, tin and lead, for example, the electrolyte may comprise zinc chloride and at least one of the salts selected from the group consisting of lithium chloride, sodium chloride, potassium chloride, aluminum chloride, magnesium chloride and calcium chloride. In the purification process, after selection of the proper current density, zinc would be deposited at the cathode and the more noble metals would remain in the anode container. A typical temperature at which the purification process may be carried out is about 450° C. Another example of purification which may be carried out in accordance with the invention includes the refining of magnesium by removing impurities such as aluminum, silicon, iron, copper, etc.

The following examples are still further illustrative of the invention.

EXAMPLE 1

An aluminum alloy containing 0.3 wt.% Si, 0.8 wt.% Fe, 0.2 wt.% Cu, 1.5 wt.% Mn, 0.03 wt.% Cr, 0.01 wt.% Ni, 0.07 wt.% Zn and 0.05 wt.% Ti was used in molten form in an anode section of a cell of the type shown in the FIGURE. Three different purification tests were performed. The anode section in the first test was fabricated from porous carbon having a porosity of 48% and in the second and third tests the anode section was fabricated from porous graphite having a porosity of 95%. In all three cases, the electrolyte consisted of 90.0 wt.% LiCl and 10.0 wt.% $AlCl_3$, and the temperature was about 750° C. In all cases, the porous member had a thickness of about ⅛ inch and the cathode-anode distance for all cases was ⅝ inch. The porous member used in the second and third cases is available from Fiber Materials Incorporated, Biddeford, Maine, and is referred to as type GH felt.

The tests were conducted with variations as shown in the following tabulation:

| Test | 1 | 2 | 3 |
|---|---|---|---|
| Porosity | 48% | 95% | 95% |
| Current Density (max.) | 1.5 amp/cm$^2$ (9.6 amp/in$^2$) | 1.5 amp/cm$^2$ (9.6 amp/in$^2$) | 4.4 amp/cm$^2$ (28 amp/in$^2$) |
| Cell Voltage | 1.8–1.9 V | 0.8–0.9 V | 1.8–1.9 V |
| Power Consumption | 18.5 MJ/kg (2.34 Kwh/lb) | 10.6 MJ/kg (1.34 Kwh/lb) | 16.7 MJ/kg (2.10 Kwh/lb) |
| Current Efficiency | 97% | 98% | 100% |
| Cathode Metal Purity | 99.75% | 99.82% | 99.64% |
| Level of Constituents Remaining in Cathode Metal | | | |
| Si | 0.030 | 0.001 | 0.02 |
| Fe | 0.044 | 0.004 | 0.06 |
| Cu | 0.015 | 0.011 | 0.03 |
| Mn | 0.14 | 0.15 | 0.23 |
| Cr | 0.002 | 0.000 | 0.00 |
| Ni | 0.000 | 0.000 | 0.00 |
| Zn | 0.014 | 0.010 | 0.02 |
| Ti | 0.003 | 0.001 | 0.00 |

From the tabulation, it can be seen that where current density was the same and only the porosity was changed, the 95% porosity membrane had significantly reduced power consumption. In tests 1 and 3, the run was performed at maximum current density which is that which permits operation of the cell just before $Cl_2$ is evolved at the anode. It will be noted that the high porosity material permitted almost a three fold increase in the current density which can be used. It will be appreciated that the increased current density is significant in that it can permit much higher productivity for a unit cell. Further, it can be seen that the level of impurity was not adversely affected by use of the high porosity membrane.

EXAMPLE 2

An aluminum alloy containing 11.7 wt.% Si, 0.21 wt.% Fe and minor amounts of other impurities was provided in molten form in an anode section of a cell, substantially as shown in the FIGURE. The anode section was fabricated from a woven graphite membrane having a porosity of about 70% and a thickness of about 0.02 to 0.04 inch. The electrolyte consisted of 90.0 wt.% LiCl and 10.0 wt.% $AlCl_3$ and the temperature was about 750° C. The current density started at about 1600 amps/ft$^2$ and reached a maximum of about 5000 amps/ft$^2$ for a short time. For the duration of the run, the cell was maintained at about 2 volts. Purified aluminum (99.9 wt.%) collected at the cathode contained 0.010 wt.% Si and 0.004 wt.% Fe.

From the above example, it can be seen that silicon and iron content of the aluminum were reduced rather significantly. Also, the current density obtained was increased significantly even though voltage was maintained about 2 volts or below. Further, it can be seen that the invention is capable of producing high purity aluminum metal at high current densities.

While the invention has been described in terms of preferred embodiments, the claims appended hereto are intended to encompass other embodiments which fall within the spirit of the invention.

What is claimed is:

1. A method of electrolytically removing impurities from metal comprising the steps of:

(a) providing a metal containing impurities in a molten state in a container having a porous membrane therein, the membrane having a porosity greater than 50% and up to about 97% and being capable of containing the molten metal and being permeable by a molten electrolyte; and (b) electrolytically transferring metal through said membrane to a cathode in the presence of the electrolyte thereby substantially removing the impurities from the metal.

2. The process according to claim 1 wherein porous carbon is employed as the porous wall.

3. The process according to claim 1 wherein said electrolyte employed comprises at least one salt selected from the group consisting of metal fluoride and metal chloride of the metal to be electrolytically transferred and at least one salt selected from the group consisting of aluminum, sodium, potassium, lithium, calcium and magnesium halide.

4. The process according to claim 1 wherein the metal is aluminum.

5. The process according to claim 4 wherein said electrolyte employed comprises at least one salt selected from the group consisting of aluminum fluoride and aluminum chloride and at least one salt selected from the group consisting of sodium, potassium, lithium, calcium and magnesium chloride.

6. The process according to claim 1 wherein the electrolyte comprises 5 to 99 wt.% LiCl and 1 to 25 wt.% $AlCl_3$.

7. The process according to claim 1 wherein the electrolyte has a temperature in the range of 675° C. to 925° C.

8. The process according to claim 1 wherein molten aluminum is capable of being electrolytically transferred at a current density of 1382 amps/ft$^2$.

9. A method of electrolytically purifying aluminum alloy comprising the steps of:

(a) providing a metal and impurities in a container having a porous carbon membrane therein, the membrane having a porosity in the range greater than 50% and up to about 97% and being capable of containing the molten metal and being permeable by a molten electrolyte containing at least one salt selected from the group consisting of aluminum fluoride and aluminum chloride and at least one salt selected from the group consisting of sodium, potassium, lithium, manganese and magnesium halide; and (b) electrolytically transferring metal through said membrane to a cathode in the presence of the electrolyte at a temperature in the range of 675° to 925° C. thereby purifying said aluminum by separating it from alloying constituents.

10. A method of electrolytically removing impurities from metal comprising the steps of:

(a) providing a metal containing impurities in a molten state in a container having a porous membrane therein, the membrane having a porosity in the range of about 70% to 97% and being capable of containing the molten metal and being permeable by a molten electrolyte; and (b) electrolytically transferring metal through said membrane to a cathode in the presence of the electrolyte thereby substantially removing the impurities from the metal.

* * * * *